US006079048A

United States Patent [19]

Campbell

[11] Patent Number: 6,079,048

[45] Date of Patent: Jun. 27, 2000

[54] SELF-ADHESIVE NAPKIN

[76] Inventor: Darlene F. Campbell, 361 Pictou Road, Truro, Nova Scotia, Canada, B2N2T6

[21] Appl. No.: 09/243,737

[22] Filed: Feb. 1, 1999

[51] Int. Cl.[7] ..... A41B 13/00; A41B 13/10

[52] U.S. Cl. ..... 2/49.1; 2/52

[58] Field of Search ..... 2/49.1, 49.4, 49.5, 2/52

[56] References Cited

U.S. PATENT DOCUMENTS

| | | | |
|---|---|---|---|
| 3,488,773 | 1/1970 | Stemmer . | |
| 4,288,877 | 9/1981 | Klepfer | 2/48 |
| 4,306,316 | 12/1981 | Klepfer | 2/48 |
| 4,423,523 | 1/1984 | Bodner et al. | 2/49.4 |
| 4,441,212 | 4/1984 | Ahr et al. | 2/49.2 |
| 4,660,226 | 4/1987 | Quilling et al. | 2/49.2 |
| 5,054,124 | 10/1991 | Darvas | 2/50 |
| 5,491,844 | 2/1996 | Kehl et al. . | |
| 5,672,056 | 9/1997 | Fisher et al. | 433/137 |
| 5,809,568 | 9/1998 | Morris-Jones | 2/49.1 |
| 5,881,382 | 3/1999 | Bernard et al. | 2/49.1 |
| 5,930,836 | 8/1999 | Morris . | |
| 5,930,837 | 8/1999 | Anvar . | |

*Primary Examiner*—John J. Calvert
*Assistant Examiner*—Shirra L. Jenkins

[57] ABSTRACT

A self-adhesive napkin having two parallel side edges, and parallel upper and lower edges. An adhesive material is located along at least the top edge thereof. A cover sheet overlies the adhesive and is adapted to be removed prior to use.

2 Claims, 2 Drawing Sheets

SELF-ADHESIVE NAPKIN

BACKGROUND OF THE INVENTION

1. Field of the Invention

The present invention relates to a self-adhesive napkin and more particularly pertains to protecting the apparel of people when eating spaghetti, lobster and other untidy means.

2. Description of the Prior Art

The use of napkins of known designs and configurations is known in the prior art. More specifically, napkins of known designs and configurations heretofore devised and utilized for the purpose of protecting the apparel of people when eating through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,733,411 to Foti discloses a Disposable Bib. U.S. Pat. No. 4,622,698 to Heyman et al. discloses a Disposable Bib. U.S. Pat. No. 4,523,334 to Lavash discloses a Disposable Bib Having Fibrous Top Sheet Wherein Mother's Bond Zone is Impregnated With Bonding Material. U.S. Pat. No. 4,523,333 to Spangler discloses a Disposable Bib Having Tape-Tab Fastener. U.S. Pat. No. Des. 357,568 to Schottland discloses the design of a Bib. Lastly, U.S. Pat. No. 4,330,888 to Klepfer discloses a Disposable Protective Garment.

While these devices fulfill their respective, particular objectives and requirements, the aforementioned patents do not describe self-adhesive napkin as described herein.

In this respect, the self-adhesive napkin according to the present invention substantially departs from the conventional concepts and designs of the prior art, and in doing so provides an apparatus primarily developed for the purpose of protecting the apparel of people when eating spaghetti, lobster and other untidy means.

Therefore, it can be appreciated that there exists a continuing need for a new and improved self-adhesive napkin which can be used for protecting the apparel of people when eating spaghetti, lobster and other untidy means. In this regard, the present invention substantially fulfills this need.

SUMMARY OF THE INVENTION

In view of the foregoing disadvantages inherent in the known types of napkins of known designs and configurations now present in the prior art, the present invention provides an improved self-adhesive napkin. As such, the general purpose of the present invention, which will be described subsequently in greater detail, is to provide a new and improved self-adhesive napkin and method which has all the advantages of the prior art and none of the disadvantages.

To attain this, the present invention essentially comprises a new and improved self-adhesive napkin for protecting the apparel of people when eating spaghetti, lobster and other untidy meals. Such napkin is formed of a sheet of material in a generally rectangular configuration. The sheet has two parallel side edges and parallel upper and lower edges. Additionally, the sheet material is formed with an exterior absorbent layer and an interior layer of moisture impervious elastomeric material. A plurality of perforations is formed in the upper edge extending downwardly in a generally continuous curve in the form of a U-shaped configuration from locations inwardly of the lateral edges. The perforations are adapted to allow separation of a neck receiving recess from the remainder of the sheet. An adhesive material is formed on the interior surface adjacent to the upper edge. The adhesive material includes two laterally spaced linear portions with a curved portion therebetween corresponding to the curvature of the perforations. A single cover sheet overlies the adhesive and is adapted to be removed prior to use. This allows the upper edge of the sheet material to be removably attached to the apparel of a wearer by the adhesive adjacent to the head of the wearer.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self-adhesive napkin which has all of the advantages of the prior art napkins of known designs and configurations and none of the disadvantages.

It is another object of the present invention to provide a new and improved self-adhesive napkin which may be easily and efficiently manufactured and marketed.

It is further object of the present invention to provide a new and improved self-adhesive napkin which is of durable and reliable constructions An even further object of the present invention is to provide a new and improved self-adhesive napkin which is susceptible of a low cost of manufacture with regard to both materials and labor, and which accordingly is then susceptible of low prices of sale to the consuming public, thereby making such self-adhesive napkin economically available to the buying public.

Even still another object of the present invention is to provide a self-adhesive napkin for protecting the apparel of people when eating spaghetti, lobster and other untidy means.

Lastly, it is an object of the present invention to provide a new and improved self-adhesive napkin. The napkin is formed of a sheet of absorbent material in a generally rectangular configuration having two parallel side edges, and parallel upper and lower edges. An adhesive material is formed on the interior surface and is located along at least the top edge thereof. Lastly, a cover sheet overlies the adhesive adapted to be removed prior to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
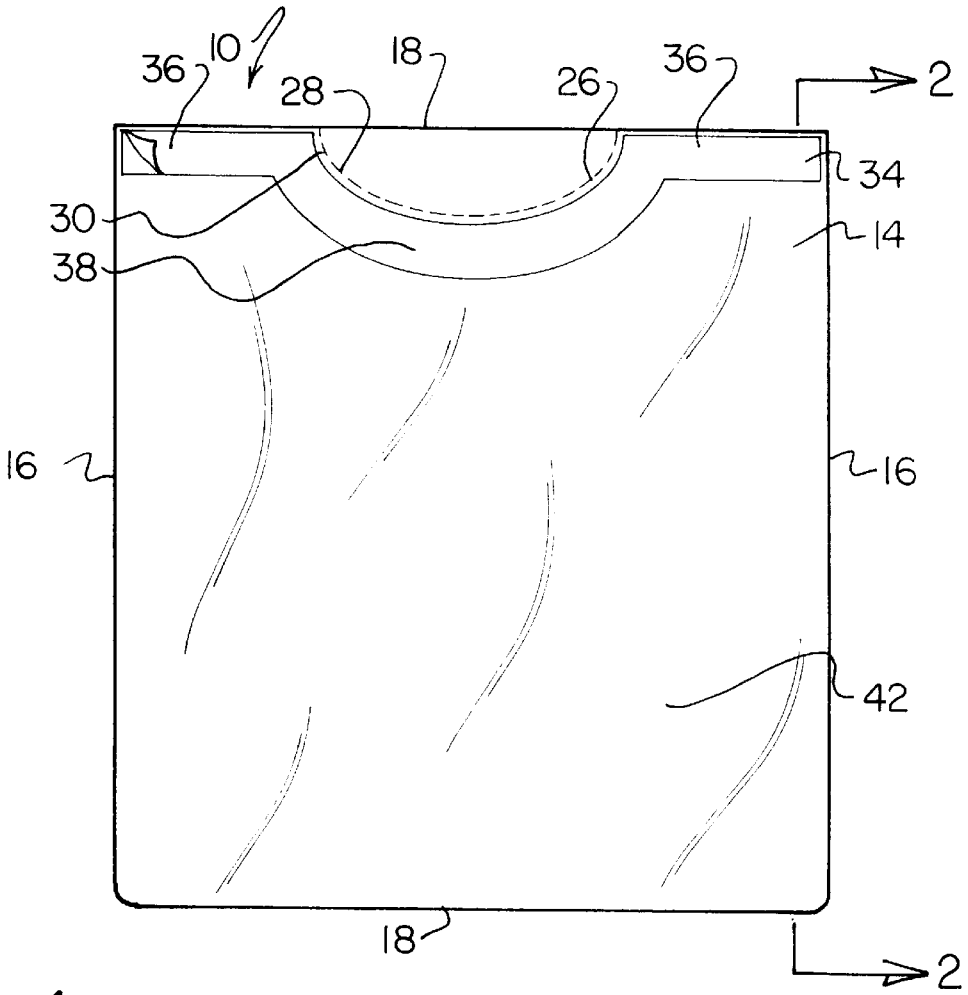
FIG. 1 is a front elevational view of the preferred embodiment of the self-adhesive napkin constructed in accordance with the principles of the present invention.

With reference now to the drawings, and in particular to FIG. 1 thereof, the preferred embodiment of the new and improved self-adhesive napkin embodying the principles and concepts of the present invention and generally designated by the reference numeral 10 will be described.

The present invention, the self-adhesive napkin 10, is comprised of a plurality of components. Such components in their broadest context include an absorbent material, a plurality of perforations and an adhesive material. Such components are individually configured and correlated with respect to each other so as to attain the desired objective.

As described herein, the new and improved self-adhesive napkin 10 is for protecting the apparel of people when eating spaghetti, lobster and other untidy meals. The napkin includes, in combination, a sheet of absorbent material 14 in a generally rectangular configuration. The rectangle has two parallel side edges 16, and parallel upper and lower edges 18. The sheet material is formed with an exterior absorbent layer 20 and may include an interior layer of moisture impervious elastomeric material 22.

A plurality of perforations 26 is formed in the upper edge. The perforations extend downwardly in a generally continuous curve in the form of a U-shaped configuration 28 at the top center of the napkin. The perforations are adapted to allow separation of a neck receiving recess 30 from the remainder of the sheet.

An adhesive material 34 is formed on the interior surface adjacent to the upper edge. The adhesive material includes two laterally spaced linear portions 36 with a curved portion 38 therebetween. This curved portions corresponds to the curvature of the perforations.

Lastly provided in the primary embodiment is a single cover sheet 42 overlying the adhesive. Such cover sheet is adapted to be removed prior to use. Such removal allows the upper edge of the sheet material to be removably attached to the apparel of a wearer by the adhesive adjacent to the head of the wearer.

Figure 3:
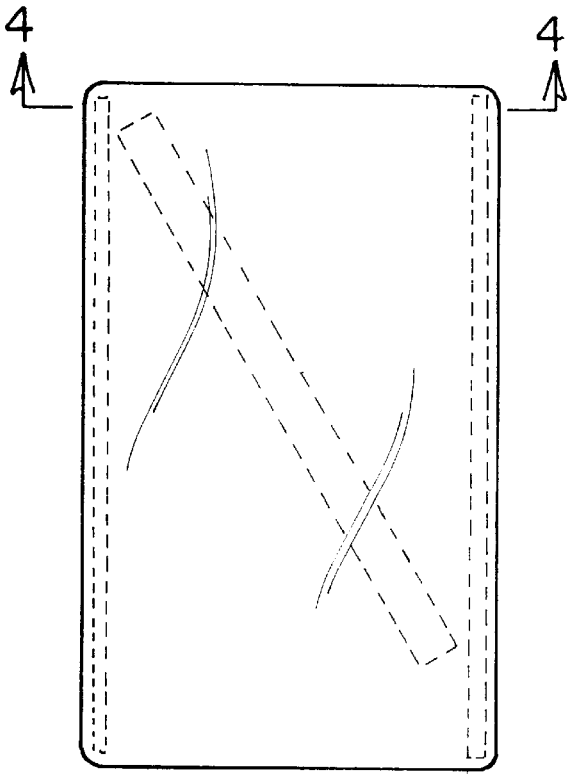
FIG. 3 illustrates a napkin constructed in accordance with an alternate embodiment of the invention.
Figure 4:
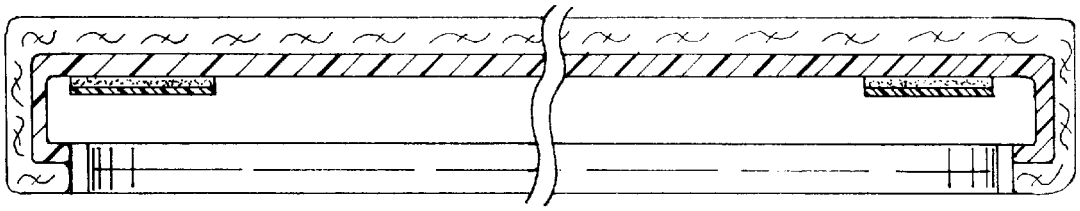
FIG. 4 is a cross-sectional view taken along line 4—4 of FIG. 3.
Figure 2A:
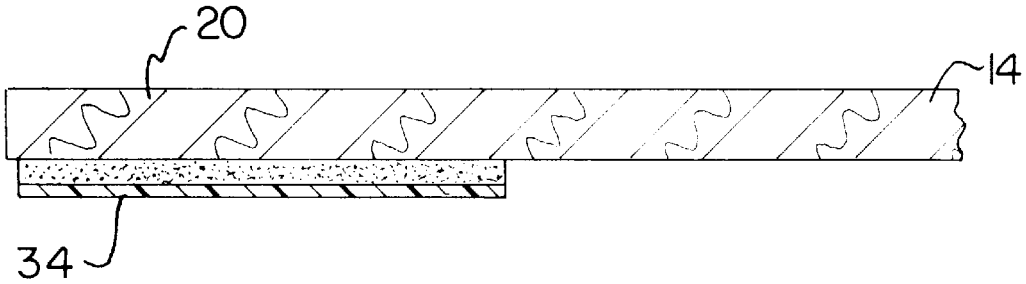
FIG. 2*a* is a cross-sectional view taken along line 2—2 of FIG. 1.
Figure 2B:
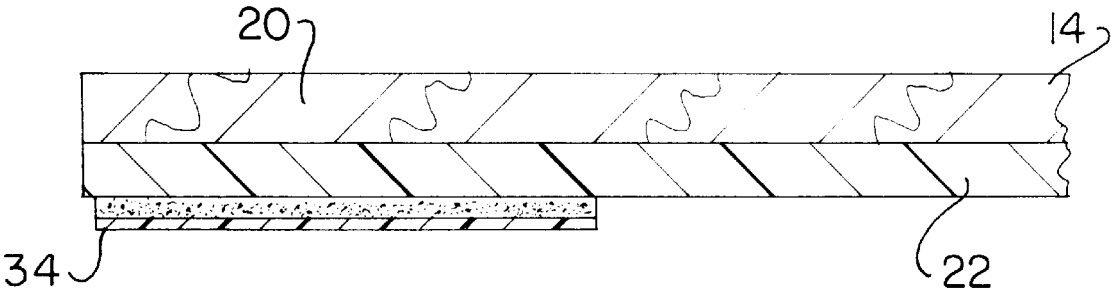
FIG. 2*b* is a cross-sectional view taken along line 2—2 of FIG. 1 but illustrating an alternate embodiment of the invention.

An alternate embodiment of the invention is shown in FIGS. 3 and 4. In such embodiment, the entire sheet of material is formed in a generally rectangular configuration without the perforations of the primary embodiment. In addition, the material includes an exterior absorbent layer and an interior layer of moisture-impervious material. Long strips of adhesive are located along the long lateral edges while short adhesive strips are located along the short upper and lower edges. In addition, an angled strip of adhesive material is located between the peripheral adhesives. Further, a plurality of cover sheets are located over each of the sections of adhesive for being removed prior to operation and use. Lastly, strips of an elastic material are located along the free edges to assist in locating the device on an object to be protected.

The self-adhesive napkin of the present invention is a disposable self-stick napkin that features a perforated neck cut-out that has many uses.

Self-adhesive napkins allow the wearer a quick, easy ways to place the napkin directly on their clothing situated on their lap. The user can also remove the perforated area and the napkin becomes a bib without a lot of unnecessary handling.

The napkins are fabricated from multi-ply paper stock with a moisture proof lining on the backside to give added protection to a wearer's clothing. The self-stick adhesive glue could be made of double adhesive tape or a self-stick glue. These tabs would be located in the upper right and left corners of the napkin and below the perforated neck line cut-out for a secure fit. The strength of the material used would depend on its usage.

Due to the self-stick napkin's simplicity and ease of application, it is also useful on airplanes where space constrictions can limit the mobility of the user and the likelihood of soiling clothing is then decreased.

Alternate designs can be produced in larger sizes and be configured with self-stick tabs on all four sides of the napkin.

Although the present invention was designed for many markets, the main area of concern is in the field of the health care system. The disabled, handicapped and seniors have a great need for such a product. Parents can also make use of this product when traveling with toddlers. Certain restaurants, such as those serving lobster, spaghetti and the like, would also find the present invention very useful.

Because of the serious cutbacks in the health care system, the present invention provides convenience in lessening the workload of the caregiving staff. Due to the ease in which the present invention is removed, the patient could put on and take off easily without requiring assistance. Laundry would be reduced due to the replacement of a throwaway in comparison to the currently utilized terry cloth.

From having had the experience of seeing patients remaining in soiled bibs, waiting for staff to help remove them, the inventor feels seniors have lost a great deal of their cherished pride. Since the inventor has always respected and looked up to her elders, she feels it is only fair and humane to give them support rather than helping in diminishing their self-esteem. The elderly do not like to be seen in a child-like bib which diminishes their morale. Thus this is the main concern and purpose of this invention.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A self-adhesive napkin for protecting the apparel of people when eating spaghetti, lobster and other untidy meals comprising, in combination:

a sheet of material in a generally rectangular configuration having two parallel side edges, and parallel upper and lower edges, the sheet material being formed with an exterior absorbent layer and an interior layer of moisture impervious elastomeric material;

a plurality of perforations formed in the upper edge extending downwardly in a generally continuous curve in the form of a U-shaped configuration from locations inwardly of the lateral edges, the perforations adapted to allow separation of a neck receiving recess from the remainder of the sheet;

an adhesive material formed on the interior surface adjacent to the upper edge including two laterally spaced linear portions with a curved portion therebetween corresponding to the curvature of the perforations, the linear portions and curved portion of the adhesive material extending downwardly a common distance from the upper edge and the continuous curve; and a single cover sheet overlying the adhesive adapted to be removed prior to use for allowing the upper edge of the sheet material to be removable attached to the apparel of a wearer by the adhesive adjacent to the head of the wearer.

2. A self-adhesive napkin comprising:

a sheet of absorbent material having an interior surface and exterior surface and having two parallel side edges, and parallel upper and lower edges;

an adhesive material located along the top edge thereof;

supplemental adhesive material formed on the interior surface adjacent to the two side edges from adjacent the upper edge to adjacent the lower edge and with an angled adhesive material therebetween; and a cover sheet overlying the adhesive adapted to be removed prior to use.

* * * * *

UNITED STATES PATENT AND TRADEMARK OFFICE

CERTIFICATE OF CORRECTION

PATENT NO : 6,079,048
DATED : 6/27/00
INVENTOR(S) : DARLENE F. CAMPBELL

It is certified that error appears in the above-identified patent and that said Letters Patent are hereby corrected as shown below:

Inventor's address is:

Darlene F. Campbell
501 Onslow Road
Truro, Nova Scotia B2N 5B3
CANADA

Signed and Sealed this

Twenty-second Day of May, 2001

*Attest:*

Nicholas P. Godici

NICHOLAS P. GODICI

*Attesting Officer*

*Acting Director of the United States Patent and Trademark Office*